United States Patent [19]

Dor

[11] 4,062,675

[45] Dec. 13, 1977

[54] ORE TREATMENT INVOLVING A HALO-METALLIZATION PROCESS

[75] Inventor: Abraham A. Dor, Lakewood, Ohio

[73] Assignee: The Hanna Mining Company, Cleveland, Ohio

[21] Appl. No.: 128,072

[22] Filed: Mar. 25, 1971

[51] Int. Cl.[2] ..... C22B 23/02

[52] U.S. Cl. ..... 75/82; 75/21; 75/90 R; 75/133.5

[58] Field of Search ..... 75/82, 113, 119, 21, 75/133.5, 90, 3

[56] References Cited

U.S. PATENT DOCUMENTS

| | | | |
|---|---|---|---|
| 484,033 | 10/1892 | MacFarlane | 75/119 X |
| 841,721 | 1/1907 | Ryan | 75/119 X |
| 1,346,175 | 7/1920 | Caron | 75/119 |
| 1,487,145 | 3/1924 | Caron | 75/119 |
| 1,780,106 | 10/1930 | Ashcroft | 75/85 |
| 1,817,865 | 8/1931 | Ashcroft | 75/113 X |
| 1,822,995 | 9/1931 | Meyer | 75/113 |
| 2,030,867 | 2/1936 | Hart | 75/113 |
| 2,067,874 | 1/1937 | Brown | 75/82 X |
| 2,677,593 | 5/1954 | Graham et al. | 75/119 X |
| 3,453,101 | 7/1969 | Takahashi et al. | 75/82 |
| 3,503,734 | 3/1970 | Bell | 75/82 |
| 3,656,935 | 4/1972 | Iwasaki | 75/82 |
| 3,761,245 | 9/1973 | Bingham | 75/82 |

FOREIGN PATENT DOCUMENTS

| | | | |
|---|---|---|---|
| 297,784 | 9/1928 | United Kingdom | 75/85 |
| 329,159 | 5/1930 | United Kingdom | 75/85 |

*Primary Examiner*—M. J. Andrews

*Attorney, Agent, or Firm*—Donnelly, Maky, Renner & Otto

[57] ABSTRACT

A pyrometallurgical process for the treatment of ores, particularly lateritic nickel ores containing nickel oxide and/or nickel silicate, employing halide and metallic iron, and optionally carbon, for extraction of the metal in concentrate form easily recoverable by magnetic separation procedures.

26 Claims, 3 Drawing Figures

Figure 1:
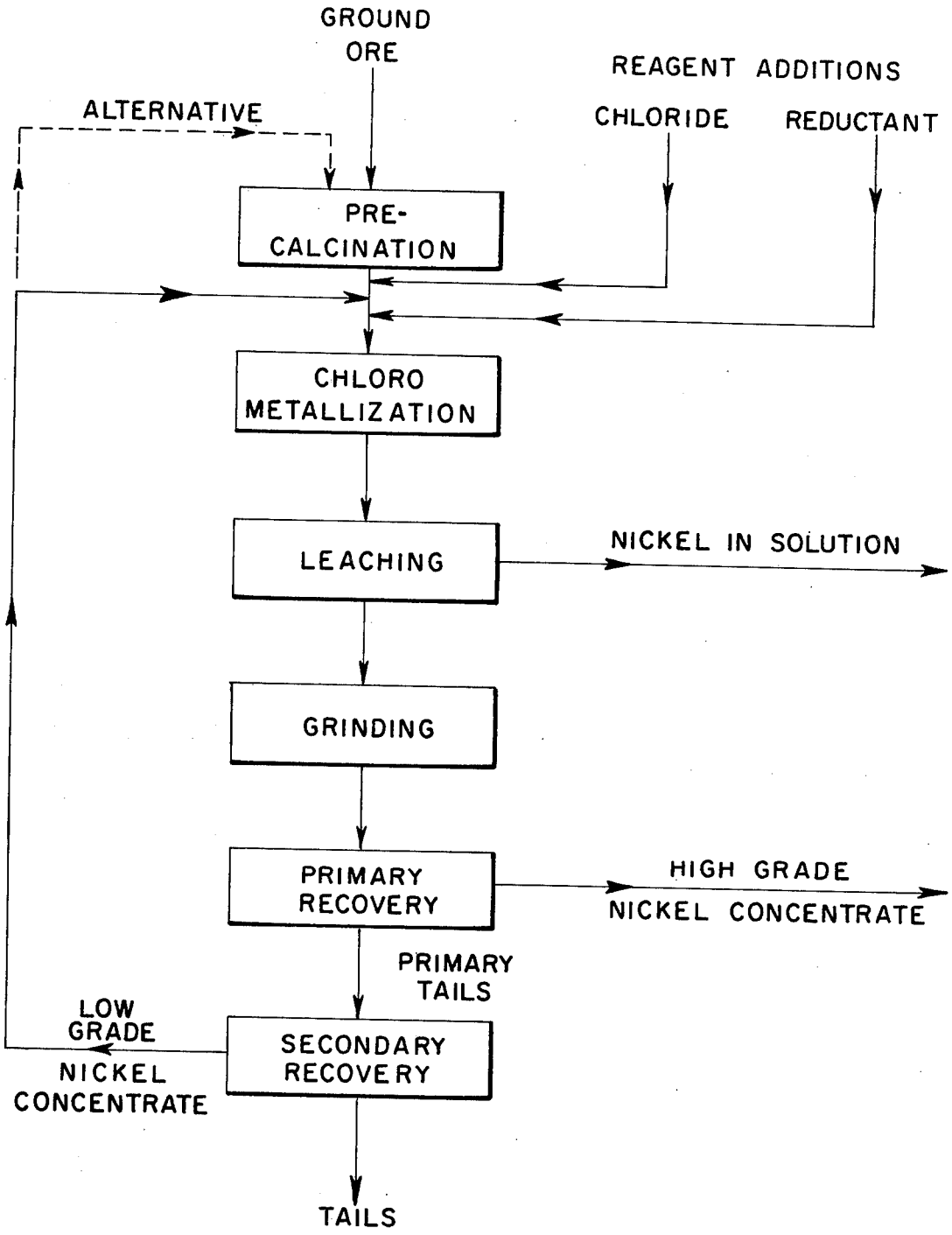

INVENTOR.
ABRAHAM A. DOR

BY

Oberlin, Maky, Donnelly & Renner
ATTORNEYS

INVENTOR.
ABRAHAM A. DOR

BY

Merlin, Maky, Donnelly & Renner
ATTORNEYS

ORE TREATMENT INVOLVING A HALO-METALLIZATION PROCESS

BACKGROUND OF THE INVENTION

Major reserves of nickel are constituted by lateritic ores in which the nickel is in the form of oxide or silicate minerals. These ores are found in localized areas where suitable climatic and hydrological conditions have existed in past geological times to promote their "laterization" accompanied by a concentration of their nickel content.

The nickel content of these lateritic deposits varies over a wide range. While in the better deposits the average nickel content may reach and even exceed 2–3% nickel, it is in the range of 1–2% nickel in the great majority of the known lateritic nickel ore reserves. Many of these deposits have been processed commercially under suitable geographic and economic circumstances. In the majority of cases, however, only the higher grade ore bodies have been exploited, utilizing principally selective electric reduction smelting processes. In a few cases, hydrometallurgical processes, based on acid leaching or selective reduction followed by ammoniacal leaching, have been applied commercially to certain medium grade ore bodies.

Because of the fact that they must treat the unbeneficiated crude oil, the commercial processes presently used for the extraction of nickel from lateritic ores are affected by restrictive economic limitations concerning the minimum grade of ore required for profitable operation. Constant efforts have therefore been made over the years to develop beneficiation processes that would yield nickel concentrates of a suitable grade from these ores. The main purpose of thse efforts was to improve the profitability of the higher grade nickel lateritic ore bodies for which existing technology is available and to make it possible, besides, to treat economically lower nickel content laterites for which present extractive technology would not be commercially profitable.

The chloridation of base metal oxides in ores or calcines that are heated in contact with alkali and alkali-earth chlorides is known art and has been applied to a wide variety of metals.

Various processes have been developed in this respect for the recovery of the base metal chlorides formed. These processes fall into the two major categories:

a. Processes in which the base metal chlorides formed are caused to volatilize and are recovered selectively from the process gases for subsequent treatment and purification (e.g. the Kowa Seiko process applied to the purification of pyrite calcines containing base metals).
b. Processes in which the base metals are precipitated selectively from their chlorides in the metallic form on carbonaceous reductants which are added to the ores or calcines simultaneously with the alkali or alkali-earth chlorides (segregation roasting).

Processes falling in the second category have first been developed for copper oxide ores over the last fifty years under the name of "segregation processes".

Caron U.S. Pat. No. 1,487,145 teaches the extraction of the values of nickel and cobalt and copper from such ores by crushing the same and subjecting them to a reducing roast by a solid reducing agent with the addition of a small amount of sodium chloride. The typical operating temperature may be 750°–800° C, although higher temperatures are contemplated, and magnetic metallic nickel is produced.

Moulden and Taplin in British Pat. No. 250,991 describe a similar roasting operation in which a particular Chilean chrysocolla ore was admixed with a solid fuel and heated for one hour at a temperature of 700° C in a vessel from which oxygen was excluded. It was found that the copper migrated from the ore particles and was found in a finely divided condition outside them. Investigation disclosed that the ore naturally contained a small proportion of sodium chloride which was essential to the success of the process. Subsequently, other oxidized copper ores which did not naturally contain any halide were roasted in a similar manner with an addition of a small amount of sodium chloride or other halide and segregation of the metallic copper was similarly successfully achieved. Carbonaceous reducing agents which may be employed include bituminous coal, graphite, coke and wood charcoal. In the case of these copper ores, it was found that a roasting temperature of from 500° to 700° C was satisfactory.

Carlos M. Diaz, in his thesis "Mechanism of the Segregation Process and Its Potential Application to Nickel Ores", Department of Mineral Engineering, Columbia University, 1958, describe a large number of experiments and concludes that they demonstrate that the segregation process is suitable for treating oxidized nickel ores.

The history of the segregation roasting process as applied particularly to copper ores is discussed in some detail by M. R. W. Rey in a paper entitled "Early Developments of the Copper Segregation Process" appearing in Volume 76 (1967) of the Transactions of the Institution of Mining and Metallurgy.

U.S. Patents which discuss the application of the segregation roasting process to nickel ores include U.S. Pats. No. 2,995,455, No. 3,033,671, No. 3,148,974 (dealing princpally with copper ores), No. 3,323,900 and No. 3,453,101. French Patent No. 1,101,906 deals with the segregation roasting of low nickel content ores including a calcined roast above 1000° C to obtain large particles, but below 1200° C to avoid sintering. Canadian Pat. No. 848,377 discloses a segregation procedure generally analogous to that used for the winning of copper from refractory oxide-silicate copper ores.

In the papers published by I. Iwasaki, Y. Takahashi, and H. Kahata entitled "Extraction of Nickel from Iron Laterites and Oxidized Nickel Ores by a Segregation Process", Transactions of AIME (1966) and by K. Nagano, K. Kojima and Y. Takahashi entitled "Extraction of Nickel from Low Grade Nickel Ores by Segregation Processs", Ninth International Mineral Processing Congress, Prague (1970), they report that they conducted a series of experiments with satisfactory results on the recovery of nickel, applying the concept of the segregation process as employed in the treatment of oxidized copper ore or copper silicate ore. Roasting temperatures between 750° C and 1100° C are mentioned, and the halide bearing material may be $CaCl_2$ or NaCl. Metallic nickel precipitates on the solid reducing agent in the same manner that copper is described as being deposited on the carbonaceous reducing agent in British Pat. No. 250,991.

The segregation roasting of refractory copper ore has been commercially developed by use of the TORCO Process described by E. T. Pinkney and N. Plint in the Transactions of the Institution of Mining and Metallurgy, Vol. 76 (1967) "Treatment of Refractory Copper Ores by the Segregation Process", and Pinkney, "The TORCO Process — recent developments", as well as by K. E. Mackay and N. Gibson, "Development of the pilot commercial TORCO plant at Rhokana Corporation, Ltd., Zambia", Vol. 77 (1968). However, the segregation roasting of nickeliferous lateritic ores does not appear to have achieved any widespread commercial success and it is believed that techniques should be employed which differ from those successfully utilized with the copper ores.

SUMMARY OF THE INVENTION

This invention relates to a novel concentration process based on the pyrometallurigical treatment of ores such as nickel lateritic ores. It utilizes operations in which halides and metallic iron in suitable form, with or without additional carbonaceous reductants, are admixed to the ores, resulting in the formation of a metal (e.g. ferro-nickel) concentrate which can be recovered by means of simple magnetic separation procedures.

Gravity separation and/or flotation recovery procedures can also be used in conjunction with or in replacement of magnetic beneficiation for the recovery of the concentrate.

While, as explaind below, certain features of the invention may be applied to the winning of a variety of metals, the invention is considered to be particularly advantageous when employed in the treatment of lateritic nickel ores. The transformation of the nickel oxides and silicates in the ore is accomplished by a combination of halidizing and reducing reactions which, for convenience, will be referred to as "halo-metallization" and generally as "chloro-metallization" where chlorides are used, as is the preferred practice.

Any alkali or alkaline-earth chloride may be used, as well as ferric, ferrous or aluminum chlorides. While other halides are similarly operable they are, with the exception of calcium and sodium fluorides, cryolite and fluorspar, ordinarily too expensive to be competitive. Metallic iron additions can be made in the form of fine or coarse powders, prereduced agglomerates or shredded scrap iron or cast iron. It can also be added advantageously in the form of "FerroCoke" (trademark) which, in the context of this invention, characterizes metallized iron agglomerates or miniballs produced in the following way:

a. Iron oxides and coal or coke are mixed in suitable proportions, and after the addition of moisture and a binder like bentonite, if necessary, are agglomerated into miniballs of a diameter smaller than 6 millimeters and preferably finer than 10 mesh.
b. The miniballs thus formed are processed in a suitable furnace (rotary kiln, multiple hearth furnace, or fluidbed roaster) in which they are heated up to a temperature of 700°- 1000° C at which they are maintained under suitable flame conditions for the time required to transform most of the iron oxide into metallic iron.

It has been found that these miniballs may be effectively and efficiently used for the chloro-metallization of nickel lateritic ores. For this purpose, it has been found that it is not essential that their iron content be completely metallized although the ratio of their metallic to total iron content should preferably be higher than 60% by weight.

It has also been found that it is not necessary that the carbon provided by the coal or coke used for the production of FerroCoke miniballs be fully consumed in the metallization of the iron oxide. In fact, in the treatment of certain nickel ores it is preferred that a certain amount of residual carbon be present.

To test various levels of metallic iron and residual fixed carbon in the FerrioCoke miniballs, various ratios of iron oxide to coal were used in their production covering a range from 1 oxide to 4 coal up to 3 oxide to 1 coal. In this way, FerroCoke miniballs containing up to about 50% carbon by weight have been tested and it has been found that they may be used effectively and efficiently for the chlorometallization of nickel lateritic ores.

It has also been found that coal or coke may be added to metallic iron and chloride. This has the effect of reducing the quantity of metallic iron that would otherwise be needed to obtain optimum conditions of chlorometallization.

The optimum levels of metallic iron and other reagent additions depend to a very large extent on the nature and composition of the nickel ores treated, and in particular, on their content of ferric and ferrous iron oxides. It has been found that the higher the iron content of the nickel ores, the higher are the levels of reagent additions required and the lower is the grade of nickel in the concentrate recovered.

Although it is not possible to anticipate in advance the exact best range of additive requirements for each of the many different lateritic ores, simple small scale crucible or rotary drum tests may be performed on any ore under investigation which enable one versed in the arts of pyrometallurgy and mineral beneficiation to apply the teachings of this invention and determine the preferred reagent levels and operating temperatures for the particular ore.

A major advantage deriving from the use of metallic iron as a sole or partial reductant in the chloro-metallization of nickel lateritic ores is the fact that it ensures the formation of a ferronickel concentrate which has a relatively high magnetic susceptibility. This makes it possible to recover it by means of simple and economic magnetic separation equipment of common design and construction.

It is evident that, though more costly in most cases, other methods of mineral beneficiation and recovery may be resorted to such as froth flotation or gravity separation. For some ores, it may be found that such procedures may be combined with magnetic separation procedures to improve the grade and/or recovery of the nickel concentrate which can be obtained. Suitable testing in such cases will enable one versed in the art to determine the most advantageous combination of mineral processing procedures for the recovery of the nickel concentrate.

The principles of the invention may be applied to the treatment of any ore where metallic iron is capable of displacing a non-ferrous metal of the ore from its halide or oxide form, such as the ores of cobalt, antimony, and copper. Similarly, sulphide ores may be pre-calcined to convert their base metal values to the oxide forms whereupon they become susceptible to treatment in accordance with the invention. The oxides and silicates are effectively treated whether naturally occurring in the raw ore or converted to such compounds from sulphides or the like.

THE DRAWING

Figure 2:
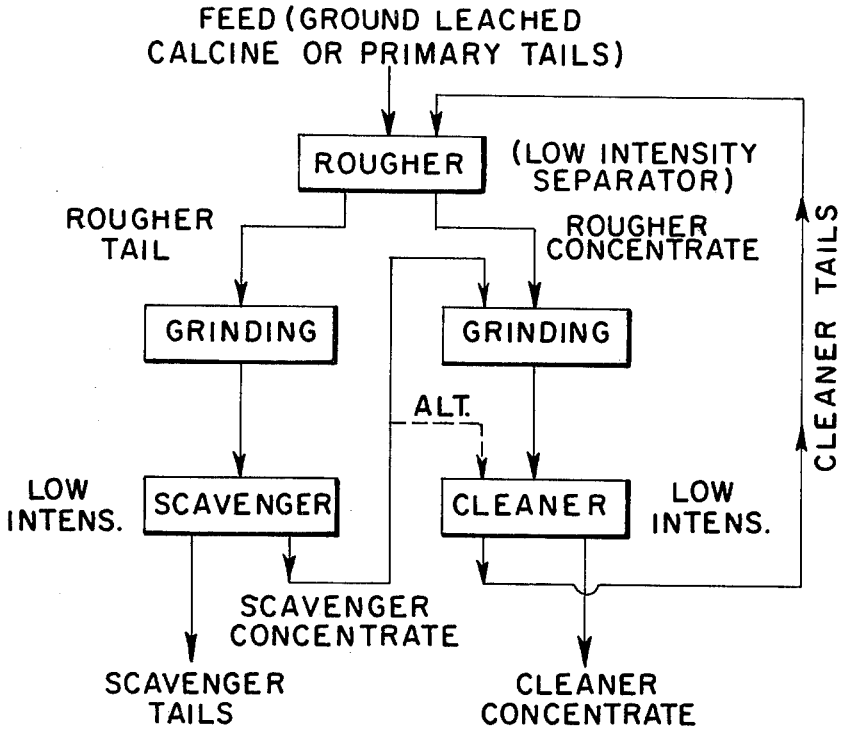
Figure 3:
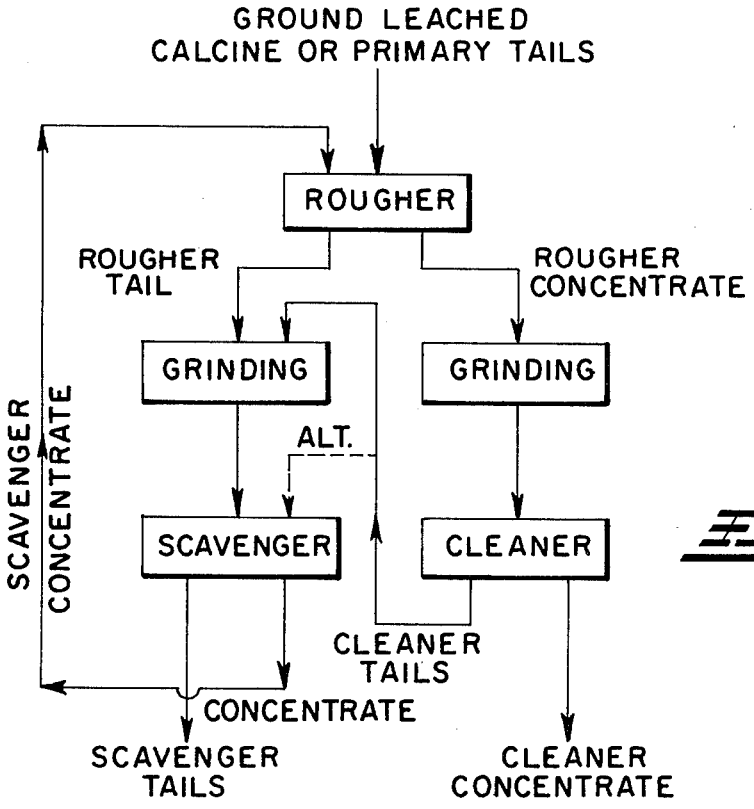

In the annexed drawing, FIG. 1 is a generalized flow diagram of a preferred process for implementing this invention; and FIGS. 2 and 3 illustrate in detail alternative procedures which may be employed in carrying out the primary recovery and/or secondary recovery operations of FIG. 1,.

DESCRIPTION OF THE INVENTION

Now referring more particularly to FIG. 1 of the drawing, a nickeliferous lateritic ore may be coarsely ground to the mesh size which tests indicate is most desirable for the chloro-metallization reactions to proceed to the degree required for maximum nickel recovery; the optimum size for each particular ore is a function of the ore mineralogy and natural grain size distribution, and may be determined by testing. As in their natural state nickel lateritic ores are usually relatively high in moisture content, they should be at least partially dried before, during or after such grinding operation and they may then desirably be agglomerated in one way or another to facilitate subsequent handling and reduce dust production.

As shown in FIG. 1, the chloro-metallization operation may be preceded by a pre-calcination step during which the partially or totally dried loose or agglomerated ground crude ore is brought to the required reaction temperature. For the great majority of nickel lateritic ores, the pre-calcination temperature should exceed 675° and preferably 700° C in order to secure complete dehydration of the serpentine they contain, and such temperature may reach 900° C to 1000° C, 900° C being the ordinary minimum temperature required for the chlorometallization step which follows. This pre-calcination operation may take place in suitable commercial kilns or furnaces such as rotary kilns, multiple hearth furnaces, and fluid bed roasters.

The pre-calcined ore will then be subjected to the chloro-metallization reactions in a suitable apparatus such as a rotary kiln, multiple hearth furnace, or moving bed vertical reactor. The several reagents employed, comprising the chloride, metallic iron or FerroCoke, and the carbonaceous reductant such as coke or coal (when used) will be added to such pre-calcined ore at or near the feed end of the chloro-metallization vessel. Alternatively, both the pre-calcination and chloro-metallization operations may be combined into a single operation which may be performed in a rotary kiln or multiple hearth furnace. In such case, the crude feed and reagents required may be loosely mixed in the kiln or furnace bed, or they may be totally or partially premixed and agglomerated prior to being charged into the kiln or furnace. For the great majority of nickel lateritic ores tested, it has been found that for the necessary reactions to proceed properly the chloro-metallization should take place at temperatures between 800° C and 1200° C, usually above 900° C, and preferably in the range of from about 950° C to about 1000° C. Depending upon the particular ore, such temperature may typically be maintained for a period of from about ½ to about 2 hours but with some ores a shorter period is effective. The resultant chloro-metallized calcine should be cooled without exposure to air to prevent oxidation and loss of nickel recovery, as by quenching in water.

Following the chloro-metallization operation, and cooling, a water leaching step is desirable to recover and recycle any soluble chlorides in the calcine. This keeps these chlorides in a controlled stream from which they may be reclaimed and either reused in the process or otherwise disposed of, thus avoiding potential pollution of plant effluent water. The leaching step also permits the recovery of soluble nickel salts at this stage which tests have shown may sometimes be formed with certain ores and certain reagent combinations. The soluble nickel salts may be precipitated and recovered by known hydrometallurgical procedures such as precipitation by carbonates or hydroxides of sodium or calcium.

The leached calcine may next be ground in order to promote maximum recovery and grade in the nickel concentrate, the desirability of such further grinding operation depending on the mineralogy and grain size distribution of the particular ore being treated. Such grinding operation may then be followed by two stages of mineral beneficiation procedures. The primary recovery stage using low intensity magnetic separation will yield a high grade nickel concentrate and primary tails. For most of the ores on which the procedures of this invention have been tested, the nickel content of the primary tails is relatively high and it is therefore advantageous to subject them to a secondary recovery step using high intensity magnetic separation in order to yield finished throw-away tails and a low grade nickel concentrate. The latter may then be recycled through the chloro-metallization operation after which it can be upgraded by magnetic concentration. Tests indicate that such recycled low grade nickel concentrate, after being thus reprocessed, will yield additional quantities of high grade concentrate when subjected to magnetic separation. As indicated in FIG. 1, such low grade nickel concentrate from the secondary recovery operation may be thus recycled either to the chloro-metallization stage or alternatively to the prior pre-calcination stage.

Referring now to FIGS. 2 and 3 of the drawing, these comprise two alternative flow diagrams of procedures which may be utilized for either the primary or secondary recovery operations of FIG. 1. In each case, three different stages of magnetic separation are employed (rougher, cleaner, scavenger), with grinding, if necessary or desirable, of the feed to such cleaner and scavenger stages. In each case, the final products are the cleaner concentrate and the scavenger tails. Because of the considerable differences between the various available lateritic ores above referred to, tests should be made to establish which of these two recovery flow diagrams is more advantageous in any particular case and also to determine whether one or both of the grinding steps and one or both of the scavenger and cleaning steps may be eliminated. Similarly, in some cases it may be advantageous to replace one or more of the high or low intensity magnetic separation stages by a flotation or gravity benefication circuit.

Following are examples of several of the tests which were run:

Example 1

| | |
|---|---|
| Ore tested: | A blend of several nickel lateritic samples from Columbia ground to minus 35 mesh in a 5½ ft. Aerofall mill. |
| Chloride used: | Calcium chloride ($CaCl_2 . 2H_2O$), minus 100 mesh. |
| Coal used: | Petroleum coke, 35 × 48 mesh. |
| Metallic Iron: | Electrolytic powder. |

Example 1-continued

| | |
|---|---|
| Procedure: | 200 gram charges of ore were mixed with the reagents selected after drying on steam tables and put in covered crucibles which were placed in an electrically heated muffle furnace preheated to the initial temperature selected for the cycle. After placement of the crucibles, the temperature was restored to the selected levels and maintained at these levels for the selected times. A nitrogen atmosphere was maintained inside the furnace. At the end of the test, the heat was turned off and the crucibles removed and placed in an indirectly cooled enclosure maintained in a nitrogen atmosphere. When cold, the crucibles were removed. A 100 gram sample was taken from each crucible and was ground for 60 minutes in a laboratory Abbe mill. A 50 gram sample from the ground product was subjected to a Davis Tube test. |

The results of the Davis Tube Tests are reported in Table 1. They indicate that for the ore tested and the levels of reagents selected, the partial replacement of coal by metallic iron improved the concentrate recovery and reduced the nickel content in the tails.

Example 2

| | |
|---|---|
| Ore tested: | A blend of low grade California lateritic ore ground to −200 mesh. |
| Reagents used: | Same as in Example 1. |
| Procedures: | Same as in Example 1. |

The Davis Tube test results are reported in Table 2. They show that for the ore tested and the levels of reagents selected, the addition of metallic iron improved the recovery and reduced the nickel content in the tails.

Example 3

| | |
|---|---|
| Ore tested: | Blends of Colombian nickel lateritic ores ground to minus 35 mesh in a 5½ ft. Aerofall mill. |
| Reagents used: | Same as in Example 1. |
| Procedures: | Same as in Example 1. |

These tests are a repeat of the best conditions reported in Example 1. The Davis Tube results are given in Table 3 and demonstrate the high recoveries achieved with partial additions of metallic iron.

Example 4

| | |
|---|---|
| Ore Tested: | A sample of Riddle Plant lateritic nickel ore ground to minus 100 mesh. |
| Chloride: | Calcium chloride as in Example 1. |
| Reductant: | FerroCoke prepared by roasting at 850° C a charge consisting of minus 6 mesh miniballs prepared by agglomerating a mixture consisting of 20% iron oxide concentrates and 80% coal, with the addition of a very small quantity of bentonite.<br>The resulting FerroCoke miniballs or pellets had the following approximate analysis:<br>Metallic Iron 14.2% by weight<br>Total Iron 20.2% by weight<br>Carbon 55.1% by weight |
| Procedure: | Same as in Example 1 except for the following differences:<br>a. The calcine taken from the crucibles was subjected to a hot water leach to recover any soluble nickel, prior to grinding.<br>b. The tails obtained in the Davis Tube tests were submitted to high intensity magnetic separation in a Carpco laboratory machine, thus recovering a lower grade nickel concentrate and rejecting a final tail.<br>The results of these tests are reported in Table 4, the figures of which show that satisfactory recoveries could be obtained over a wide range of FerroCoke additions. |

Example 5

| | |
|---|---|
| Ore Tested: | A blend of Riddle lateritic nickel ore and rejects ground to minus 48 mesh in a 5½ ft. Aerofall mill and precalcined at about 950° C in a pilot rotary kiln. |
| Chloride: | Calcium Chloride as in Example 1. |
| Reductant: | FerroCoke as in Example 4. |
| Procedure: | Same as in Example 6.<br>The results of these tests are reported on Table 5 and confirm the wide range over which FerroCoke could be used effectively. |

Example 6

| | |
|---|---|
| Ore Tested: | A blend of Riddle lateritic nickel ore and Riddle rejects ground to minus 48 mesh in a 5½ ft. Aerofall mill. |
| Chloride: | Calcium Chloride as in Example 1. |
| Coal: | Utah Coal ground to minus 100 mesh. |
| Metallic Iron: | Electrolytic powder. |
| Procedure: | Same as in Example 4 except that the soluble nickel was recovered in the water used for grinding the calcine prior to processing in the Davis Tube, and that the Davis Tube tails were not submitted to high intensity magnetic separation in all tests.<br>The results of these tests are reported in Table 5, and illustrate the improvement in recovery obtained at the level of coal additions used when metallic iron is added. |

Example 7

| | |
|---|---|
| Ore Tested: | A blend of Riddle lateritic nickel ore and Riddle rejects ground to minus 48 mesh in a 5½ ft. Aerofall Mill and precalcined at about 950° C in a pilot rotary kiln. |
| Chloride: | Calcium Chloride as in Example 1. |
| Coal: | Eastern Coal ground to minus 100 mesh. |
| Metallic Iron: | Electrolytic Powder. |
| Procedure: | Same as Example 6. The results of these tests are reported on Table 6 and illustrate the improvement in recovery obtained when metallic iron is added, at the levels of coal used. |

Example 8

| | |
|---|---|
| Ore Tested: | A blend of Colombia nickel ores ground to minus 35 mesh in a 5½ ft. Aerofall Mill and precalcined at 950° C in a laboratory rotary kiln. |
| Chloride: | Calcium Chloride as in Example 1. |
| Reductant: | FerroCoke prepared as in Example 4 from a mixture consisting of 25% iron oxide concentrate and 75% coal and having the following approximate analysis:<br>Metallic Iron 16.5%<br>Total Iron 25.7%<br>Carbon 50.4% |
| Procedure: | Same as in Example 6.<br>The results of these tests are reported in Table 8 and show the wide range over which satisfactory recoveries could be obtained with FerroCoke. |

Example 9

| | |
|---|---|
| Ore Tested: | Same as in Example 8. |
| Chloride: | Calcium Chloride as in Example 1. |
| Metallic Iron: | Electrolytic powder. |
| Procedure: | Same as in Example 6, with high intensity magnetic separation applied on Davis Tube tails in all tests.<br>The results of these tests are reported on Table 9 and show the wide range over which metallic could be used effectively as the sole reductant. |

Example 10

| | |
|---|---|
| Ore Tested: | Same as in Example 7. |
| Chloride: | Calcium Chloride as in Example 1. |
| Metallic Iron: | Electrolytic powder. |
| Procedure: | Same as in Example 6. The results of these tests are reported in Table 10 and confirm, on a different ore sample, the wide range of effectiveness of metallic iron used as a sole reductant. |

Example 11

| | |
|---|---|
| Ore Tested: | Same as in Example 7. |
| Chloride: | Ferric chloride ($FeCl_3 . 6H_2O$). |
| Reductant: | FerroCoke as in Example 8. |
| Procedure: | Suitable quantities of dried ore, FerroCoke and liquid ferric chloride mixed in the right proportions, were formed into small-size agglomerates and dried. After drying, 200 grams of agglomerates were put in crucibles and processed in a muffle furnace as in Example 1. After removal from the furnace, the calcines were processed as in Example 9. The results of these tests are reported in Table 11 and shown that ferric chloride could be used effectively as a chloridizing agent with FerroCoke as a reductant. |

Example 12

| | |
|---|---|
| Ore tested: | Same as in Example 7. |
| Chloride: | Ferrous Chloride ($FeCl_2 . 4H_2O$) |
| Reductant: | FerroCoke as in Example 8. |
| Procedure: | As in Example 11, except that the Davis Tube tails were not subjected to high intensity magnetic separation. The test results are shown in Table 12 and indicate that ferrous chloride could also be used as a chloridizing agent with FerroCoke as a reductant. |

With regard to the foregoing tests and the following Tables, the analyses of the ores being treated are as follows, the major constituents being given in per cent by weight, on a dry basis:

| Samples | | A | B | C | D |
|---|---|---|---|---|---|
| Ni | % | 2.9 | 1 | 1.55 | .9 |
| Fe | % | 21 | 30 | 9 | 7 |
| MgO | % | 13 | 12 | 29 | 36 |
| $SiO_2$ | % | 14 | 21 | 43 | 44 |
| $Al_2O_3$ | % | 3 | 4 | 1 | 2 |

Sample A was used in Example 3, and also in Examples 8 and 9 after pre-calcination. Sample B was used in Example 2. Sample C was used in Example 4. Sample D was used in Example 6, and also in Examples 5, 7, 10, 11 and 12 after pre-calcination.

In Example 1, a sample was employed closely similar to Sample A in general composition.

TABLE 1*

| Ore Tested: | Blend of Colombia nickel ores | | | | | |
|---|---|---|---|---|---|---|
| Temperature Cycle | 30 Min. 700° C - 60 Min. 950° C | | | | | |
| Reagent Additions | | | | | | |
| Calcium Chloride % | 3 | 3 | 6 | 6 | 9 | 9 |
| Metallic Iron % | — | 2 | — | 2 | — | 2 |
| Petroleum Coke % | 4 | 2 | 4 | 2 | 4 | 2 |
| Davis Tube Results | | | | | | |
| Heads: Calc. Grade % Ni | 2.86 | 2.85 | 2.67 | 2.78 | 2.33 | 2.42 |
| Concentrate Wt. % | 7.7 | 5.0 | 9.3 | 7.0 | 4.4 | 3.4 |
| Grade % Ni | 19.2 | 37.0 | 22.5 | 36.0 | 28.0 | 58.0 |
| Tails Grade % Ni | 1.48 | 1.04 | 0.64 | 0.27 | 1.16 | 0.49 |
| Nickel Recovery % | 52.1 | 65.3 | 78.3 | 91.0 | 52.4 | 80.4 |

*All percentages given in this and the other tables are by weight.

TABLE 2

| Ore Tested: | California low grade nickel ore | | | | | |
|---|---|---|---|---|---|---|
| Temperature Cycle | 30 Min. 700° C - 60 Min. 950° C | | | | | |
| Reagent Additions* | | | | | | |
| Calcium Chloride % | 3 | 3 | 6 | 6 | 9 | 9 |
| Metallic Iron % | — | 2 | — | 2 | — | 2 |
| Petroleum Coke % | 4 | 4 | 4 | 4 | 4 | 4 |
| Davis Tube Results | | | | | | |
| Heads: Calc. Grade % Ni | 0.86 | 0.84 | 0.82 | 0.75 | 0.70 | 0.76 |
| Concentrate Wt. % | 3.4 | 4.5 | 2.7 | 1.9 | 1.3 | 3.7 |
| Grade % Ni | 12.4 | 11.3 | 15.1 | 20.2 | 23.7 | 13.0 |
| Tails Grade % Ni | 0.46 | 0.34 | 0.42 | 0.37 | 0.39 | 0.29 |
| Nickel Recovery | 48.4 | 61.1 | 49.8 | 51.7 | 45.3 | 63.2 |

*In addition 0.5% coke were spread on top of the crucibles to maintain a slightly reducing atmosphere.

TABLE 3

| Ore Tested: | Blend of Colombia Nickel Ores | | |
|---|---|---|---|
| Temperature Cycle | 30 Min. 700° C - 60 Min. 950° C | | |
| Reagent Additions* | | | |
| Calcium Chloride | % | 6 | 9 |
| Metallic Iron | % | 2 | 2 |
| Petroleum Coke | % | 2 | 2 |
| Davis Tube Results | | | |
| Heads: Calc. Grade | % Ni | 2.66 | 2.68 |
| Concentrate Wt. | % | 6.4 | 5.0 |
| Grade | % Ni | 37.5 | 48.4 |
| Tails Grade | % Ni | 0.28 | 0.25 |
| Nickel Recovery | % | 90.4 | 91.1 |

*In addition, 0.5% coke were spread on top of the crucibles to maintain a slightly reducing atmosphere.

TABLE 4

| Ore Tested: | Riddle Plant Ore | | | | |
|---|---|---|---|---|---|
| Temperature Cycle | 30 Min. 700° C - 60 Min. 950° C | | | | |
| Reagents Additions* | | | | | |
| Calcium Chloride | % | 8 | 8 | 8 | 8 |
| FerroCoke | % | 2 | 3 | 4 | 5 |
| Soluble Nickel | | | | | |
| Solution Volume | cc | 500 | 500 | 500 | 500 |
| Nickel Content | ppm | 201 | 201 | 207 | 217 |
| Davis Tube Separator | | | | | |
| Heads: Calc. Grade | % Ni | 1.46 | 1.47 | 1.46 | 1.37 |
| Concentrate Wt. | % | 2.9 | 3.0 | 3.0 | 2.9 |
| Grade | % Ni | 39.2 | 36.0 | 33.8 | 32.0 |
| Tails Grade | % Ni | 0.36 | 0.42 | 0.48 | 0.50 |
| Carpco Separator | | | | | |
| (10,000 Gauss) | | | | | |
| Concentrate Wt. | % | 15.1 | 22.9 | 24.2 | 23.0 |
| Grade | % Ni | 0.79 | 0.87 | 1.05 | 1.08 |
| Tails Wt. | % | 82.0 | 74.1 | 72.8 | 74.1 |
| Grade | % Ni | 0.29 | 0.25 | 0.26 | 0.26 |
| Nickel Distribution | | | | | |
| Soluble Nickel | % | 3.3 | 3.4 | 3.4 | 3.8 |
| Davis Tube Concentrate | % | 73.8 | 71.3 | 67.4 | 65.3 |
| Total High Grade Conc. | % | 77.1 | 74.7 | 70.8 | 69.1 |
| Carpco Concentrate | % | 7.6 | 13.1 | 16.7 | 17.4 |
| Total Conc. | % | 84.7 | 87.8 | 87.5 | 86.5 |
| Tails | % | 15.3 | 12.2 | 12.5 | 13.5 |

*In addition, 0.5% coke were spread on top of the crucibles to maintain a slightly reducing atmosphere.

TABLE 5

| Ore Tested: | Precalcined Riddle Ore Blend | | | |
|---|---|---|---|---|
| Temperature Cycle | 90 Min. 950° C | | | |
| Reagent Additions* | | | | |
| Calcium Chloride | % | 4 | 6 | 8 |
| FerroCoke | % | 2 | 2 | 2 |
| Davis Tube Results | | | | |
| Heads: Calc. Grade | % Ni | 0.91 | 1.01 | 0.94 |
| Concentrate Wt. | % | 2.1 | 2.2 | 1.75 |
| Grade | % Ni | 24.0 | 28.2 | 30.6 |
| Tails Grade | % Ni | 0.41 | 0.40 | 0.41 |
| Nickel Recovery | % | 55.8 | 61.4 | 57.1 |

*In addition, 0.5% coal were spread on top of the crucibles to maintain a slightly reducing atmosphere.

TABLE 6

| Ore Tested: | Riddle Ore Blend | | | |
|---|---|---|---|---|
| Temperature Cycle | 30 Min. 775° C - 90 Min. 950° C | | | |
| Reagents Additions* | | | | |
| Calcium Chloride | % | 8 | 8 | 8 | 8 |
| Metallic Iron | % | — | 0.5 | 1.0 | 1.5 |

TABLE 6-continued

| | | | | | |
|---|---|---|---|---|---|
| Coal | % | 1 | 1 | 1 | 1 |
| Soluble Nickel | | | | | |
| Solution Volume | cc | 2000 | 2000 | 2000 | 2000 |
| Nickel Content | ppm | 3.3 | 10.2 | 13.7 | 38.0 |
| Davis Tube Separator | | | | | |
| Heads: Calc. Grade | % Ni | 1.18 | 1.09 | 1.07 | 1.02 |
| Concentrate Wt. | % | 2.0 | 2.2 | 2.25 | 1.95 |
| Grade | % Ni | 38.1 | 34.8 | 32.4 | 34.8 |
| Tails Grade | % Ni | 0.42 | 0.36 | 0.39 | 0.39 |
| Carpco Separator | | | | | |
| (10,000 Gauss) | | | | | |
| Concentrate Wt. | % | — | 14.7 | 14.7 | 15.1 |
| Grade | % Ni | — | 0.67 | 0.77 | 0.80 |
| Tails Wt. | % | — | 83.1 | 83.05 | 82.95 |
| Grade | % Ni | — | 0.27 | 0.27 | 0.26 |
| Nickel Distribution | | | | | |
| Soluble Nickel | % | 0.6 | 1.8 | 2.5 | 7.0 |
| Davis Tube Concentrate | % | 64.6 | 69.2 | 66.7 | 62.1 |
| Total High Grade Conc. | % | 65.2 | 71.0 | 69.2 | 69.1 |
| Carpco Concentrate | % | | 8.8 | 10.3 | 11.1 |
| Total Concentrate | % | | 79.8 | 79.5 | 80.2 |
| Tails | % | | 20.2 | 20.5 | 19.8 |

*In addition, 0.5% coal were spread on top of the crucibles to maintain a slightly reducing atmosphere.

TABLE 7

| Ore Tested: | Precalcined Riddle Ore Blend | | | | |
|---|---|---|---|---|---|
| Temperature Cycle | 90 Min. 950° C | | | | |
| Reagents Additions* | | | | | |
| Calcium Chloride | % | 8 | 8 | 8 | 8 |
| Metallic Iron | % | — | 1 | 3 | 5 |
| Coal | % | 2 | 2 | 2 | 2 |
| Soluble Nickel | | | | | |
| Solution Volume | cc | 2000 | 2000 | 2000 | 2000 |
| Nickel Content | ppm | 13.5 | 37 | 78 | 90 |
| Davis Tube Separator | | | | | |
| Heads: Calc. Grade | % Ni | 0.88 | 0.87 | 0.78 | 0.76 |
| Concentrate Wt. | % | 1.1 | 1.2 | 1.4 | 1.4 |
| Grade | % Ni | 43.8 | 41.0 | 30.6 | 25.2 |
| Tails Grade | % Ni | 0.41 | 0.40 | 0.37 | 0.41 |
| Carpco Separator | | | | | |
| (10,000 Gauss) | | | | | |
| Concentrate Wt. | % | — | 21.4 | 26.3 | — |
| Grade | % Ni | — | 0.65 | 0.61 | — |
| Tails Wt. | % | — | 77.4 | 72.3 | — |
| Grade | % Ni | — | 0.30 | 0.26 | — |
| Nickel Distribution | | | | | |
| Soluble Nickel | % | 3.0 | 7.8 | 16.7 | 19.1 |
| Davis Tube Concentrate | % | 52.2 | 53.0 | 46.1 | 38.1 |
| Total High Grade Conc. | % | 55.2 | 60.8 | 62.8 | 57.2 |
| Carpco Concentrate | % | | 14.7 | 17.1 | |
| Total Concentrate | % | | 75.5 | 79.9 | |
| Tails | % | | 24.5 | 20.1 | |

*In addition, 0.5% coal were spread on top of the crucibles to maintain a slightly reducing atmosphere.

TABLE 8

| Ore Tested: | Precalcined Colombia Ore Blend | | | | |
|---|---|---|---|---|---|
| Temperature Cycle | 90 Min. 950° C | | | | |
| Reagent Additions* | | | | | |
| Calcium Chloride | % | 8 | 8 | 8 | 8 |
| FerroCoke | % | 2 | 3 | 4 | 5 |
| Soluble Nickel | | | | | |
| Solution Volume | cc | 2000 | 2000 | 2000 | 2000 |
| Nickel Content | ppm | 77 | 128 | 138 | 203 |
| Davis Tube Separator | | | | | |
| Heads: Calc. Grade | % Ni | 2.95 | 3.00 | 3.05 | 2.96 |
| Concentrate Wt. | % | 0.4 | 3.7 | 6.9 | 8.2 |
| Grade | % Ni | 71.1 | 68.8 | 39.8 | 31.6 |
| Tails Grade | % Ni | 2.68 | 0.47 | 0.36 | 0.44 |
| Carpco Separator | | | | | |
| (10,000 Gauss) | | | | | |
| Concentrate Wt. | % | — | — | 21.4 | 24.4 |
| Grade | % Ni | — | — | 0.89 | 0.91 |
| Tails Wt. | % | — | — | 71.7 | 67.4 |
| Grade | % Ni | — | — | 0.16 | 0.22 |
| Nickel Distribution | | | | | |
| Soluble Nickel | % | 5.0 | 7.8 | 8.3 | 12.1 |
| Davis Tube Concentrate | % | 9.1 | 78.4 | 82.6 | 76.9 |
| Total High Grade Conc. | % | 14.1 | 86.2 | 90.9 | 89.0 |
| Carpco Concentrate | % | | | 5.7 | 6.6 |
| Total Concentrate | % | | | 96.6 | 95.6 |

TABLE 8-continued

| | | | |
|---|---|---|---|
| Tails | % | 3.4 | 4.4 |

*In addition, 0.5% coal were spread on top of the crucibles to maintain a slightly reducing atmosphere.

TABLE 9

| Ore Tested: | Precalcined Colombia Ore Blend | | | | |
|---|---|---|---|---|---|
| Temperature Cycle | 90 Min. 950° C | | | | |
| Reagents Additions* | | | | | |
| Calcium Chloride | % | 8 | 8 | 8 | 8 |
| Metallic Iron | % | 16 | 20 | 26 | 30 |
| Soluble Nickel | | | | | |
| Solution Volume | cc | 2000 | 2000 | 2000 | 2000 |
| Nickel Content | ppm | 332 | 260 | 134 | 75.5 |
| Davis Tube Separator | | | | | |
| Heads: Calc. Grade | % Ni | 2.03 | 2.04 | 2.27 | 2.26 |
| Concentrate Wt. | % | 1.3 | 4.6 | 8.5 | 12.0 |
| Grade | % Ni | 53.6 | 33.4 | 22.0 | 15.2 |
| Tails Grade | % Ni | 1.26 | 0.56 | 0.46 | 0.50 |
| Carpco Separator | | | | | |
| (10,000 Gauss) | | | | | |
| Concentrate Wt. | % | 26.3 | 32.6 | 32.6 | 34.4 |
| Grade | % Ni | 2.34 | 0.99 | 0.67 | 0.68 |
| Tails Wt. | % | 72.4 | 62.8 | 58.9 | 53.6 |
| Grade | % Ni | 0.67 | 0.31 | 0.30 | 0.37 |
| Nickel Distribution | | | | | |
| Soluble Nickel | % | 27.1 | 20.2 | 10.6 | 6.3 |
| Davis Tube Concentrate | % | 28.1 | 59.6 | 73.8 | 75.8 |
| Total High Grade Conc. | % | 55.2 | 79.8 | 84.4 | 82.1 |
| Carpco Concentrate | % | 25.0 | 12.6 | 8.6 | 9.7 |
| Total Concentrate | % | 80.2 | 92.4 | 93.0 | 91.8 |
| Tails | % | 19.8 | 7.6 | 7.0 | 8.2 |

*In addition, 0.5% coke were spread on top of the crucibles to maintain a slightly reducing atmosphere.

TABLE 10

| Ore Tested: | Precalcined Riddle Ore Blend | | | | |
|---|---|---|---|---|---|
| Temperature Cycle | 90 Min. 950° C | | | | |
| Reagents Additions | | | | | |
| Calcium Chloride | % | 8 | 8 | 8 | 8 |
| Metallic Iron | % | 10 | 12 | 14 | 16 |
| Soluble Nickel | | | | | |
| Solution Volume | cc | 2000 | 2000 | 2000 | 2000 |
| Nickel Content | ppm | 83 | 63 | 50.5 | 40.5 |
| Davis Tube Separator | | | | | |
| Heads: Calc. Grade | % Ni | 0.80 | 0.85 | 0.86 | 0.83 |
| Concentrate Wt. | % | 4.0 | 5.4 | 7.8 | 8.4 |
| Grade | % Ni | 12.2 | 9.8 | 7.0 | 6.2 |
| Tails Grade | % Ni | 0.33 | 0.31* | 0.34 | 0.34 |
| Carpco Separator | | | | | |
| (10,000 Gauss) | | | | | |
| Concentrate Wt. | % | — | 22.4 | 24.7 | — |
| Grade | % Ni | — | 0.41 | 0.45 | — |
| Tails Wt. | % | | 72.2 | 68.3 | |
| Grade | % Ni | — | 0.32* | 0.29 | — |
| Nickel Distribution | | | | | |
| Soluble Nickel | % | 17.2 | 12.9 | 11.5 | 8.9 |
| Davis Tube Concentrate | % | 50.2 | 54.1 | 56.5 | 52.0 |
| Total High Grade Conc. | % | 67.6 | 67.0 | 68.0 | 65.9 |
| Carpco Concentrate | % | | 9.4 | 11.5 | |
| Total Concentrate | % | | 76.4 | 79.5 | |
| Tails | % | | 23.6 | 20.5 | |

*These are assay figures and are consistent within the limits of assay accuracy.

TABLE 11

| Ore Tested: | Precalcined Riddle Ore Blend | | |
|---|---|---|---|
| Temperature Cycle | 90 Min. 950° C | | |
| Reagents Additions | | | |
| Ferric Chloride | % | 12 | 12 | 12 |
| FerroCoke | % | 2 | 4 | 5 |
| Soluble Nickel | | | | |
| Solution Volume | cc | 2000 | 2000 | 2000 |
| Nickel Content | ppm | 0.3 | 0.1 | 0.1 |
| Davis Tube Separator | | | | |
| Heads: Calc. Grade | % Ni | 1.18 | 1.08 | 1.02 |
| Concentrate Wt. | % | 2.15 | 5.1 | 5.75 |
| Grade | % Ni | 33.8 | 15.0 | 12.7 |
| Tails Grade | % Ni | 0.38* | 0.35 | 0.34 |
| Carpco Separator | | | | |
| (10,000 Gauss) | | | | |
| Concentrate Wt. | % | 26.7 | 29.2 | 24.9 |
| Grade | % Ni | 0.66 | 0.50 | 0.49 |
| Tails Wt. | % | 71.1 | 65.7 | 69.4 |

TABLE 11-continued

| | | | | |
|---|---|---|---|---|
| Grade | % Ni | 0.38* | 0.26 | 0.25 |
| Nickel Distribution | | | | |
| Soluble Nickel | % | — | — | — |
| Davis Tube Concentrate | % | 61.7 | 70.4 | 71.6 |
| Total High Grade Conc. | % | 61.7 | 70.4 | 71.6 |
| Carpco Concentrate | % | 15.3 | 13.9 | 11.8 |
| Total Concentrate | % | 77.0 | 84.3 | 83.4 |
| Tails | % | 23.0 | 15.7 | 16.6 |

*These are assay figures and are consistent within the limits of assay accuracy.

TABLE 12

| | | | | | |
|---|---|---|---|---|---|
| Ore Tested: | | Precalcined Riddle Ore Blend | | | |
| Temperature Cycle | | 90 Min. 950° C | | | |
| Reagent Additions | | | | | |
| Ferrous Chloride | % | 8 | 8 | 10 | 10 |
| FerroCoke | % | 3 | 4 | 3 | 4 |
| Davis Tube Results** | | | | | |
| Heads: Calc. Grade | % Ni | 1.11 | 1.11 | 1.07 | 1.06 |
| Concentrate Wt. | % | 3.75 | 4.4 | 3.9 | 4.4 |
| Grade | % Ni | 17.3 | 15.0 | 16.4 | 14.1 |
| Tails Grade | % Ni | 0.48 | 0.47 | 0.45 | 0.46 |
| Nickel Recovery | | 58.6 | 59.5 | 59.8 | 58.5 |

**No significant recovery of soluble nickel.

The 12 examples set forth above show the wide range of effective utilization of metallic iron, FerroCoke, and also of mixtures of metallic iron and coal as reductants in the processes covered by this invention for the treatment of nickel oxide and silicate ores and the recovery of nickel concentrates from these ores.

The levels at which metallic iron and FerroCoke should be added to obtain satisfactory grades depend, as the results of the tests reported show, on the types of ore treated. Persons versed in the arts can determine these levels by means of proper laboratory or pilot scale tests, in accordance with the teachings of this invention. Usually, these levels will be found to increase as the iron content of the ore increases.

When FerroCoke containing ratios of metallic to iron to carbon in the range of 1 to 4 up to 2 to 1 by weight are used, it has been found that the FerroCoke addition needed will not exceed generally 10% by weight and will preferably be in the range of 2–6% by weight of the dry ore processed.

When mixtures of metallic iron and coal are used, where 1% by weight or more of coal is utilized, it has been found that the additions of metallic iron needed will not exceed generally 6% by weight and preferably will be in the range of 0.5 to 4% by weight of the dry ore processed.

When metallic iron is solely used, it has been found that the quantities needed increase appreciably with the iron content of the ore as illustrated respectively in Examples 9 (Colombia ore blend containing 22% Fe approximately) and 10 (Riddle ore blend containing 7% Fe approximately). Usually, they will not exceed generally twice the iron content of the ore and will preferably be in the range of 1–1.5 times this content by weight.

An important characteristic of FerroCoke is that it represents a synthetic composite reductant combining the qualities and properties of both coal and metallic iron which is finely divided and uniformly distributed through the carbonaceous material. It constitutes a multiple action reductant for the nickel chlorides formed during the chloro-metallization process covered by this invention. One of its features is that because of its metallic iron content, this synthetic reductant has ferromagnetic properties and can be recovered by magnetic separation. It can be used for the processing of oxides of other metals than nickel which, like copper, cobalt, bismuth, antimony, can be precipitated from their chlorides on either or both of metallic iron and carbon, with the production of a concentrate which can be recovered magnetically, in accordance with the process of this invention. While the roasting temperature will ordinarily be between about 800° C and 1200° C, in the case of copper ores it may be between 700° C and 850° C.

The process of this invention is adapted for employment with non-ferrous base metal oxide ores, which term is intended to be inclusive of naturally occurring minerals where the non-ferrous base metals exist in their oxide, carbonate, or silicate forms as well as of calcined or roasted products derived from natural ores which have been treated (as by calcination) to transform them into such forms, and also fo chemically produced (e.g. precipitated) oxides, carbonates and silicates.

When employing ferric chloride or ferrous chloride as the halide in the roating process of this invention, particularly in conjunction with the FerroCoke miniballs, chloro-metallization can generally be performed effectively at a relatively low temperature on the order of 850° C when treating lateritic nickel ores which require temperatures of around 950° C when other halides are used. Not only is such relatively low temperature operation economical in the use of fuel but also various possible operational problems such as ringing and sticking are minimized. On occasion mixtures of halides, e.g., ferric chloride and calcium chloride, may be utilized with advantage because of the increased range of temperature effectiveness of such mixtures due to the fact that the action of ferric chloride will start at the lower temperature and then as that temperature is gradually increased, the calcium chloride becomes effective in its turn.

It will also be understood that the ore may be ground and agglomerated with the halde to form small compacts or pellets, or such grond ore, halide, and iron (with or without carbonaceous material) may similarly be agglomerated or balled. On the other hand, agglomerates of OxyCoal (trademark) made from mixtures of iron oxide and carbonaceous material (e.g. coal) may be employed in the roasting process of the invention without prior reduction of such iron oxide to metallic iron, which will take place during the early stages of the roasting process.

While the chlorides are usually the least expensive and therefore the most economic halides for commercial use, fluorspar and cryolite are also relatively inexpensive and may be substituted for the chlorides when treating ores similar to those described in Examples 1–12 above.

I therefore particularly point out and distinctly claim as my invention:

1. In a roasting process for the treatment of nickel or cobalt-containing ores wherein such ore is heated together with a solid reducing agent and a halide to cause the cobalt or nickel content of such ore to transfer from the gangue and deposit as metal on such solid reducing agent; the improvement comprising incorporating added metallic iron as at least a component of such a reducing agent, and depositing at least a portion of such metal upon such iron.

2. The process of claim 1, wherein said halide is selected from the class consisting of sodium chloride, potassium chloride, magnesium chloride, calcium chloride, ferrous chloride, ferric chloride, aluminum chloride, sodium fluoride, and calcium fluoride.

3. The process of claim 1, wherein such halide is an iron halide.

4. The process of claim 1, wherein metallic iron constitutes substantially the only reducing agent thus employed.

5. The process of claim 1, wherein such reducing agent also comprises solid carbonaceous material.

6. The process of claim 1, wherein such ore is ground and pre-calcined prior to addition of such halide.

7. The process of claim 1, wherein such ore and halide are agglomerated together.

8. The process of claim 1, wherein such ore, halide, and reducing agent are agglomerated together.

9. The process of claim 1, wherein such metal and iron are thereafter together separated from such gangue by a magnetic separation operation.

10. In a roasting process for the treatment of nickel or cobalt oxide ore wherein such ore is heated together with a solid carbonaceous reducing agent and a halide effective to cause the metal content of such ore to transfer from the gangue and deposit as metal on such solid carbonaceous reducing agent; the improvement comprising adding finely divided metallic iron with such solid carbonaceous reducing agent, and depositing such metal on such reducing agent in close association with such iron.

11. The process of claim 10, wherein such reducing agent and finely divided metallic iron are together in the form of agglomerates comprising such reducing agent and partially reduced iron oxide.

12. The process of claim 10, wherein such metal and iron are thereafter together separated from such gangue by a magnetic separation operation.

13. A halometallization process for the treatment of lateritic nickel ore which comprises coarsely grinding said ore to reduce the ore to particles of suitable size, adding to the ground ore a solid reducing agent and a metal chloride, said reducing agent comprising metallic iron as at least one component, heating the mixture of ore, chloride and reducing agent at a temperature of from about 700° to 1200° C. to cause the nickel of said ore to transfer from the gangue and deposit as metal on such solid reducing agent, and thereafter separating said nickel and iron from the gangue by a magnetic separation technique.

14. The process of claim 13 wherein the mixture of ore, chloride and reducing agent are agglomerated together prior to heating.

15. The process of claim 13 wherein the ground ore is calcined prior to the addition of the chloride and reducing agent.

16. The process of claim 13 wherein the ore is calcined prior to the grinding operation.

17. The process of claim 13 wherein the reducing agent comprises metallic iron and a solid carbonaceous reducing agent added as agglomerated particles.

18. The process of claim 13 wherein the ore is calcined and ground, and thereafter agglomerated with the chloride and reducing agent.

19. A process for the recovery of nickel which comprises admixing particulate nickeliferous-laterite ore, a particulate chloride-containing material and a magnetic iron-containing material of particulate iron to provide an intimate admixture consisting of said materials, roasting said intimate admixture at a temperature to effect solely an in situ reaction between the bound nickel in the nickeliferous ore and the chloride-containing material to form nickel chloride and, substantially simultaneously with the formation thereof, reduction of the nickel chloride to nickel by the magnetic iron-containing material, and recovering metallic nickel from the roasted mixture.

20. The process of claim 19 wherein said chloride-containing material is selected from calcium chloride, sodium chloride, magnesium chloride and ferrous chloride.

21. The process for the recovery of nickel which comprises calcining a nickeliferous-laterite ore to remove at least a substantial portion of the free water and combined water therefrom, admixing said calcined ore in particulate form, a particulate chloride-containing material and a magnetic iron-containing material of particulate iron to provide an intimate admixture consisting of said materials, roasting said admixture at a high temperature to effect solely an in situ reaction between the bound nickel in te nickeliferous ore and the chloride-containing material to form nickel chloride and, substantially simultaneously with the formation thereof, reduction of the nickel chloride to nickel by the iron-containing material, and recovering metallic nickel from said roasted mixture.

22. The process of claim 21 wherein said chloride-containing material is calcium chloride.

23. The process of claim 21 wherein said chloride-containing material is selected from calcium chloride, sodium chloride, magnesium chloride, and ferrous chloride.

24. The process of claim 21 wherein said calcining and roasting steps are carried out simultaneously.

25. The process of claim 21 wherein said calcining is carried out at a temperature of about 1290° to 1832° F. for ½ to 2 hours.

26. The process of claim 21 wherein said roasting is carried out at a temperature of about 1472° to 2192° F. for ½ to 1 hour.

* * * * *